US007150378B2

(12) United States Patent
Dean et al.

(10) Patent No.: US 7,150,378 B2
(45) Date of Patent: Dec. 19, 2006

(54) CLEAN CONTAINER FOR PAINT AND OTHER FLUIDS

(76) Inventors: Richard A Dean, 6699 Via Estrada, 6, La Jolla, CA (US) 92037; Tharold Eugene Northup, 14706 High Valley Rd., Poway, CA (US) 92064

( * ) Notice: Subject to any disclaimer, the term of this patent is extended or adjusted under 35 U.S.C. 154(b) by 398 days.

(21) Appl. No.: 10/813,769

(22) Filed: Mar. 31, 2004

(65) Prior Publication Data

US 2004/0195267 A1 Oct. 7, 2004

Related U.S. Application Data

(60) Provisional application No. 60/459,907, filed on Apr. 1, 2003.

(51) Int. Cl.
*B67B 5/00* (2006.01)

(52) U.S. Cl. ..... 222/153.14; 222/566; 220/293

(58) Field of Classification Search ..... 222/153.14, 222/481, 489, 531, 532, 544, 545, 548, 566; 220/570, 694, 695, 904, 733, 289, 290, 293, 220/298, 495.02

See application file for complete search history.

(56) References Cited

U.S. PATENT DOCUMENTS

| | | | | |
|---|---|---|---|---|
| 1,376,103 | A * | 4/1921 | Krogmann | 222/481 |
| 1,943,314 | A * | 1/1934 | Hothersall | 222/481 |
| 4,893,723 | A * | 1/1990 | Seabolt | 220/570 |
| 4,911,319 | A * | 3/1990 | DeJean | 222/570 |
| 5,855,304 | A * | 1/1999 | Dean et al. | 222/481 |
| 6,341,721 | B1 * | 1/2002 | Herald et al. | 222/548 |

* cited by examiner

*Primary Examiner*—Lien M. Ngo
(74) *Attorney, Agent, or Firm*—John R. Ross; John R. Ross, III

(57) ABSTRACT

A container body has a main opening large enough to permit passage of large paintbrushes or sprayer suction lines and filters. This opening is covered with a large cap that comprises a bayonet-type seal. Special features in the cap and in the body combine to provide a swivel pour valve permitting contents of the container to be poured from the can in a controlled manner with no spillage or mess. The cap has a close position, a remove-replace position and a pour position. A sealed-closed position is achieved with cap rotation in a first rotation direction from a first cap remove-replace position and the pour position is achieved by cap rotation in the same rotation direction from a second cap remove-replace position. Preferably a pour vent is provided. It could be covered with a threaded screw or snap-on cover.

15 Claims, 8 Drawing Sheets

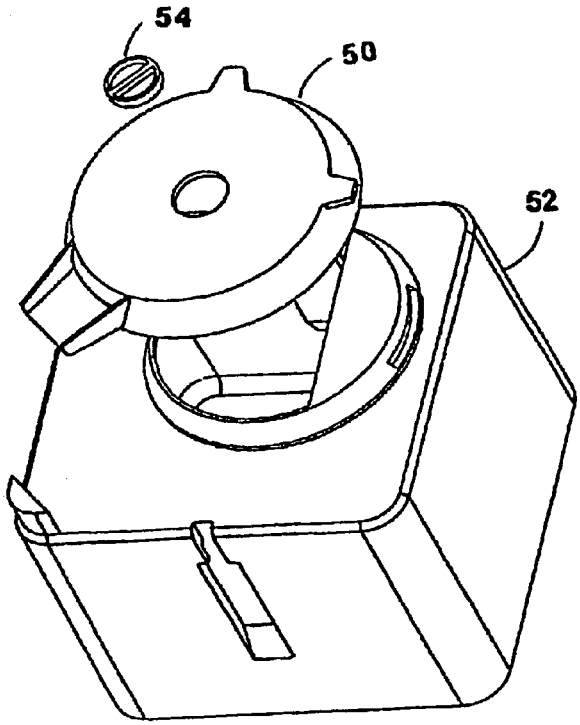
FIG. 1
PRIOR ART
FIG. 2
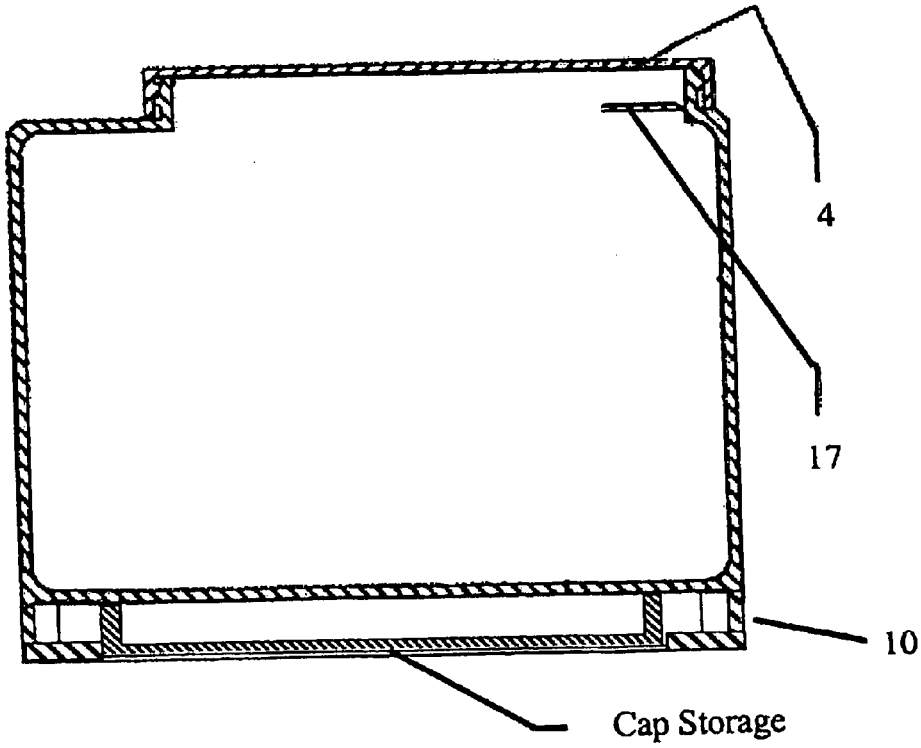

With Cap Removed 5
2
4
5
1. Closed Position 50A
2. Position for Cap Removal
Twist
22.5°
22.5°
Twist
6

Cap Lock Tab
Cap Lock
50B
3. Position of Cap Prior to Twisting into Pour Position 8
4. Pour Position Almost Closed (before twisting into locked position)
Conical Rim
Bayonet Tab on Inside Rim of Cap Fully Closed (after twisting into locked position)
Conical Rim
Bayonet Tab on Inside Rim of Cap
58

60 to 70 Degrees
59
42
54
Cap
4

57
Conical Rim
Bayonet Tab on Inside Rim of Cap
56
2

Pull-up to Unlock

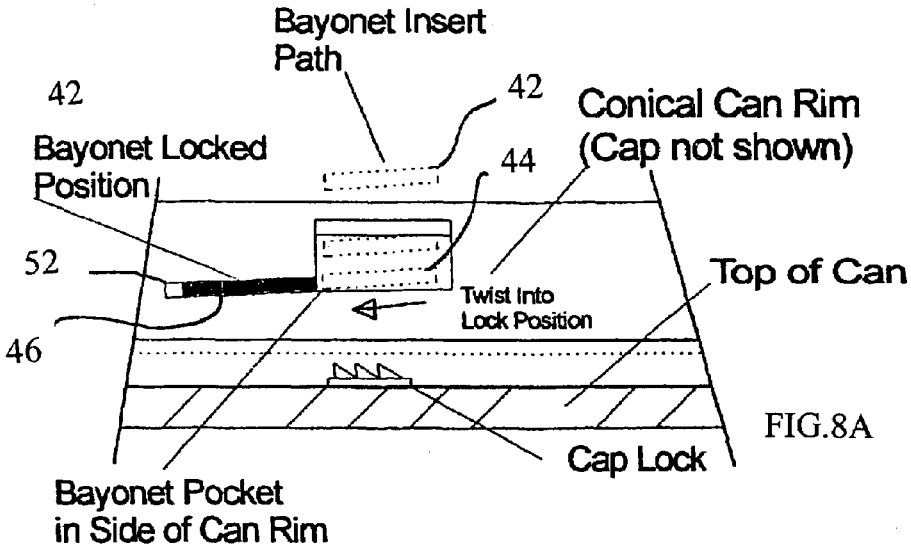
FIG.8A
FIG. 8B
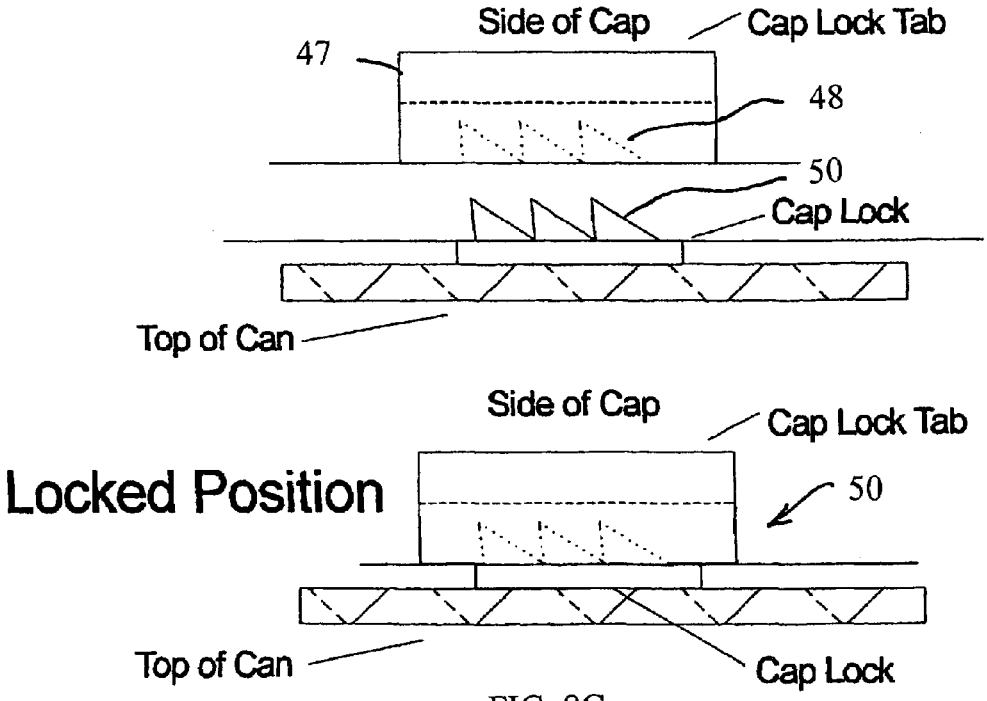
FIG. 8C

Clockwise Locking

Counter Clockwise Locking

FIG. 11
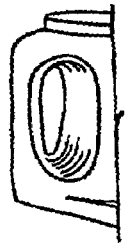
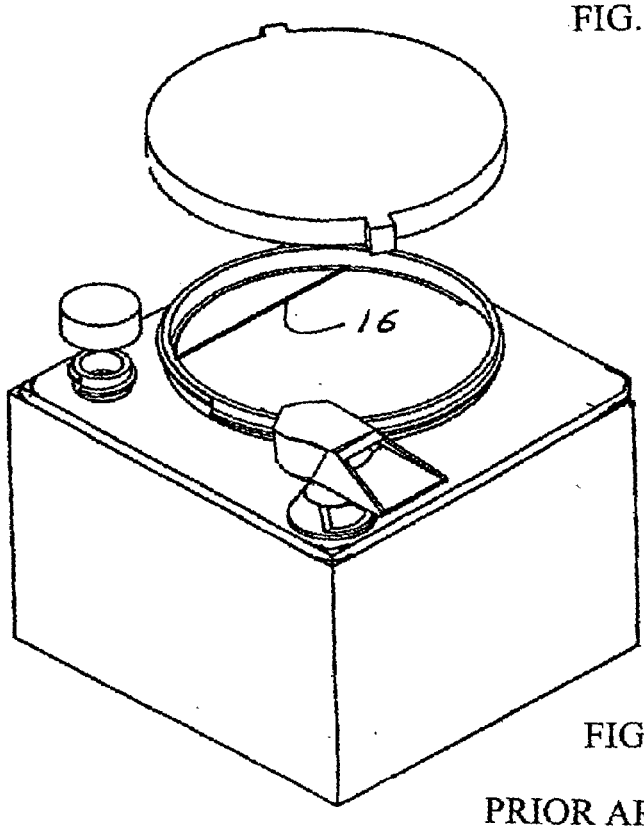
FIG. 10
PRIOR ART
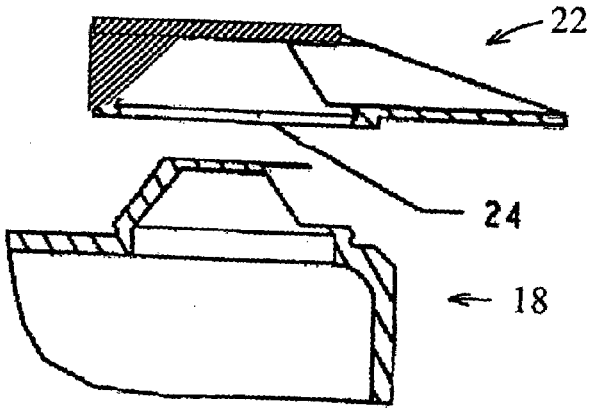
FIG. 10A
PRIOR ART

CLEAN CONTAINER FOR PAINT AND OTHER FLUIDS

This application claims the benefit of Provisional Application Ser. No. 60/459,907 filed Apr. 1, 2003. The present invention relates to containers and in particular to paint cans.

BACKGROUND OF THE INVENTION

Paint in the United States is normally supplied for the home use retail market in ½ pint, pint, quart and 1-gallon cylindrical metal containers formed of metal with removable tops. The removable tops of 1-gallon and smaller cans have a convoluted rim that is press fit into a matching rim, to form a tight seal. Often paint poured from these cans into other containers (smaller cans, paint roller pans, etc.) for more efficient use, flows over and into the convoluted edge which inevitably contaminates the seating area and runs down the side of the can and often on to work area forming a paint ring where the can sits. When a paintbrush is dipped into the can and then drug across the curved rim area, paint also gets into the sealing area. Upon resealing the can, this contamination can result in a less than airtight seal and the remaining paint may dry out during storage. Due to the configuration of the top convoluted edge of the can being located radially inward from the periphery, it is difficult to get all of the paint poured out causing waste and leaving residual material creating disposal issues.

Paint is also sold in larger containers such as a standard 5-gallon metal or plastic container. The lids of these containers are often provided with a small removable seal cap used for adding color or other additives. Paint can be poured from the 5-gallon can through the seal cap or by removing the complete lid. This contaminates with paint the top area around the seal cap and usually the side of the can. Paint can also be removed from the 5-gallon cans with power suction lines. Insertion of the suction lines and strainers often requires the complete top of a 5-gallon can to be removed which breaks the seal. Some 5-gallon cans brought on the market recently are using slightly larger seal caps.

Unused paint is usually stored in its original can. Repeated opening and closing of the top gradually reduces the sealing capability allowing air and moisture to enter or paint to seep out when can is upset. Each repeated opening becomes more difficult to affect a tight seal. The surfaces of the 1-gallon and smaller cans that are not pre-coated easily rust when exposed to humid conditions. Since the convoluted seal is not very tight due to paint and rust contamination, moisture gets inside the can which causes rusting and contamination of the remaining good paint unless rust prevention interior coatings are used. This rusting in the rim area also makes it difficult to subsequently remove the top, and after only a few openings, pliers are usually required. Liquid paint left in the convoluted seal as a result of pouring inevitably splatters when the top is pressed or hammered into place.

The cylindrical shape of any can of any size does not provide for economical shipping and storage of paint. One-gallon cans are usually shipped in cardboard boxes, 4 to a box. Up to about 27% of the available shipping space is not used. One and 5-gallon cans are stored and displayed in stores and warehouses in stacked columns with up to about 27% wasted space. Many adapters have been devised for attachment to the top of paint cans, but these adapters are typically messy to use. They have had only limited success in solving the problems discussed above.

A relative new plastic square paint can, introduced by Dutch Boy®, has features that include a pliable plastic holding bail, a handle cast into the side of the can, and a large, deep closure cap with two external lugs for assistance in unscrewing. An internal formed lip at the top of the can provides a pouring channel for the contents and a place to wipe off a paintbrush without contaminating the closure. The closure cap fits over this pouring channel when screwed onto the can body. The bottom of the plastic can has a slight indentation the shape of the top of the closure cap to enable stacking of cans. The can body is made of two parts, a main body and a snap-in ring that forms the pouring channel. The Dutch Boy® plastic can does not permit complete emptying of the contents. Paint gets between the two body parts, the pouring action is not free of messy paint on the side of the can or from drips off of the top of the snap-in pour channel. Stacking is susceptible to easily sliding off the lower unit. The formed handle in the main body takes up content space thereby increasing the height of the can to compensate and provide for a full gallon. The formed handle in the corner of the can turns out to be difficult to use in holding a full can while using a brush for painting. U.S. Pat. No. 5,855,304 issued to the present Applicants described a square plastic paint can with a large screw cap and a small swivel pour valve. Water coolers with swivel pour valves are commercially available, and many square cans made of both plastic and metal are used commercially for the containment of a great variety of products.

What is needed is an improved can for paint and other fluids

SUMMARY OF INVENTION

The present invention provides a container for holding paint or other liquids, including consumable liquids such as fruit juices and drinking water. It is an improved version of the can described in U.S. Pat. No. 5,855,304. A container body has a main opening large enough to permit passage of large paintbrushes or sprayer suction lines and filters. This opening is covered with a large cap that comprises a bayonet-type seal. Special features in the cap and in the body combine to provide a swivel pour valve permitting contents of the container to be poured from the can in a controlled manner with no spillage or mess. The cap has a close position, a remove-replace position and a pour position. A sealed-closed position is achieved with cap rotation in a first rotation direction from a first cap remove-replace position and the pour position is achieved by cap rotation in the same rotation direction from a second cap remove-replace position. Preferably a pour vent is provided. It could be covered with a threaded screw or snap-on cover. The vent also provides a place to add color or additives. The vent may also be located in the cap or the body. In preferred embodiments, a removable soft round hand-bail is provided. In preferred embodiments a space under the can is provided for storing the cap when the can is being used so the cap does not make a mess and it cannot be stepped on. The container preferably has an approximately rectangular, hexagonal or square bottom with rounded corners and rectangular sides with rounded corners. In preferred embodiments it is a locking seal with a release tab for a close position and a pour position. Special features make the can securely stackable without orientation providing space savings of about 20 percent as compared to round metal cans. The can is preferably made of plastic materials that eliminate problems of rust, other corrosion problems and problems associated with paint adhering to can surfaces. The body of the container could also be made of metal or glass.

The present invention provides paint cans with substantial advantages over prior art metal, and even new plastic, paint cans. These advantages include a no drip spout that can pour as little as one ounce without any dripping. The container can be opened and closed without tools. There is no lid seal that deteriorates with repeated openings. There is no contamination of sealing surfaces or can exterior with use. In preferred embodiments there is no corrosion of a lid seal or the inside of the can. In preferred embodiments the can comprises a straight brush wipe so that paint from the brush drips back into the can. The square can permits at least 20 percent more paint volume for shipping and storage on store shelves. The container can be completely emptied without spilling. Preferred embodiments of the can is more stable than prior art paint cans and is less likely to be overturned. The design is suitable for small, medium and large cans. It is reusable for refilling with paint from a larger container and storing paint originally packaged in conventional paint cans or for other uses in home shops or offices, thus reducing disposal volume. All openings can be covered with metallic foil or stick-on seals for shipping and storage if needed for extra seal protection and for proof of no tampering.

Preferred embodiments of this invention is very useful for many liquids other than paint. Its easy pour and resealing features make the present invention ideal for inks, dyes and fruit juices and other consumable liquids including drinking water in family style sizes. In fact almost anything that needs to be poured for use could be sold in a container of the present invention. In addition, containers of the present invention may be marketed as containers to end users who would use them as a resealable pitcher.

BRIEF DESCRIPTION OF THE DRAWINGS

FIG. 1 is a drawing of a prior art paint can from Applicants' '304 paint can patent.

FIG. 2 shows an important feature of the present invention.

FIGS. 8A–C show detail of a locking mechanism to hold the lid in its closed and pour positions.

FIGS. 10 and 10A show features of the '304 paint can.

FIG. 11 shows a handle used on a preferred embodiment.

DETAILED DESCRIPTION OF PREFERRED EMBODIMENTS

First Preferred Embodiment

Paint Can

Figure 3A:
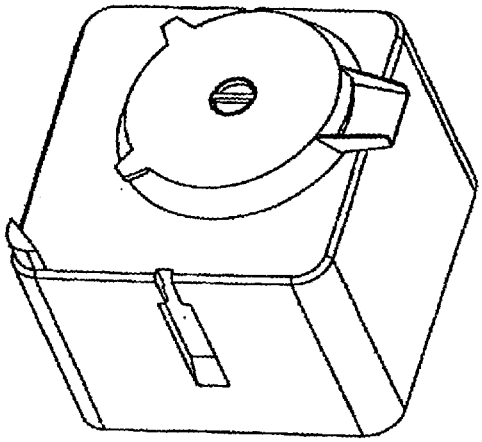
FIG. 3A PRIOR ART
FIGS. 3A and B and 4A and B show views of Applicants' 304 patent.
Figure 3B:
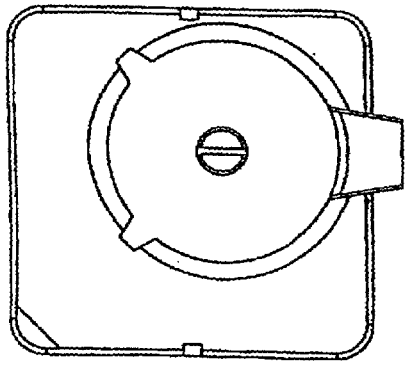
FIG. 3B PRIOR ART
Figure 4A:
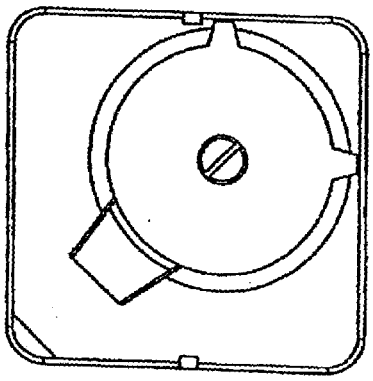
PRIOR ART FIG. 4A
Figure 4B:
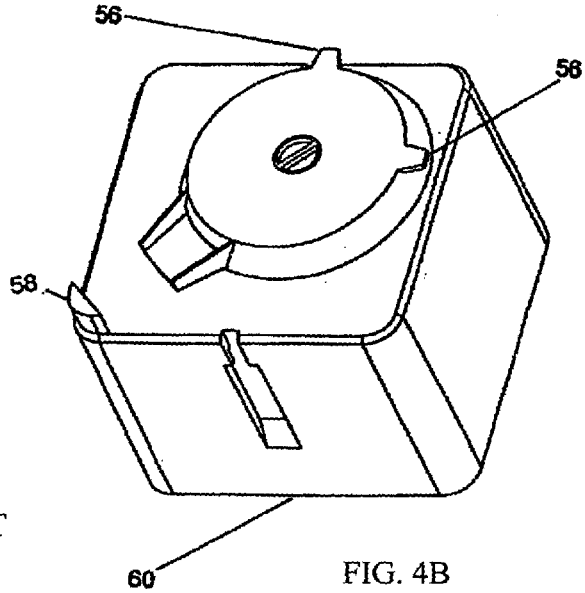
FIG. 4B PRIOR ART
Figures 6A, 6B, 6C, 6D:
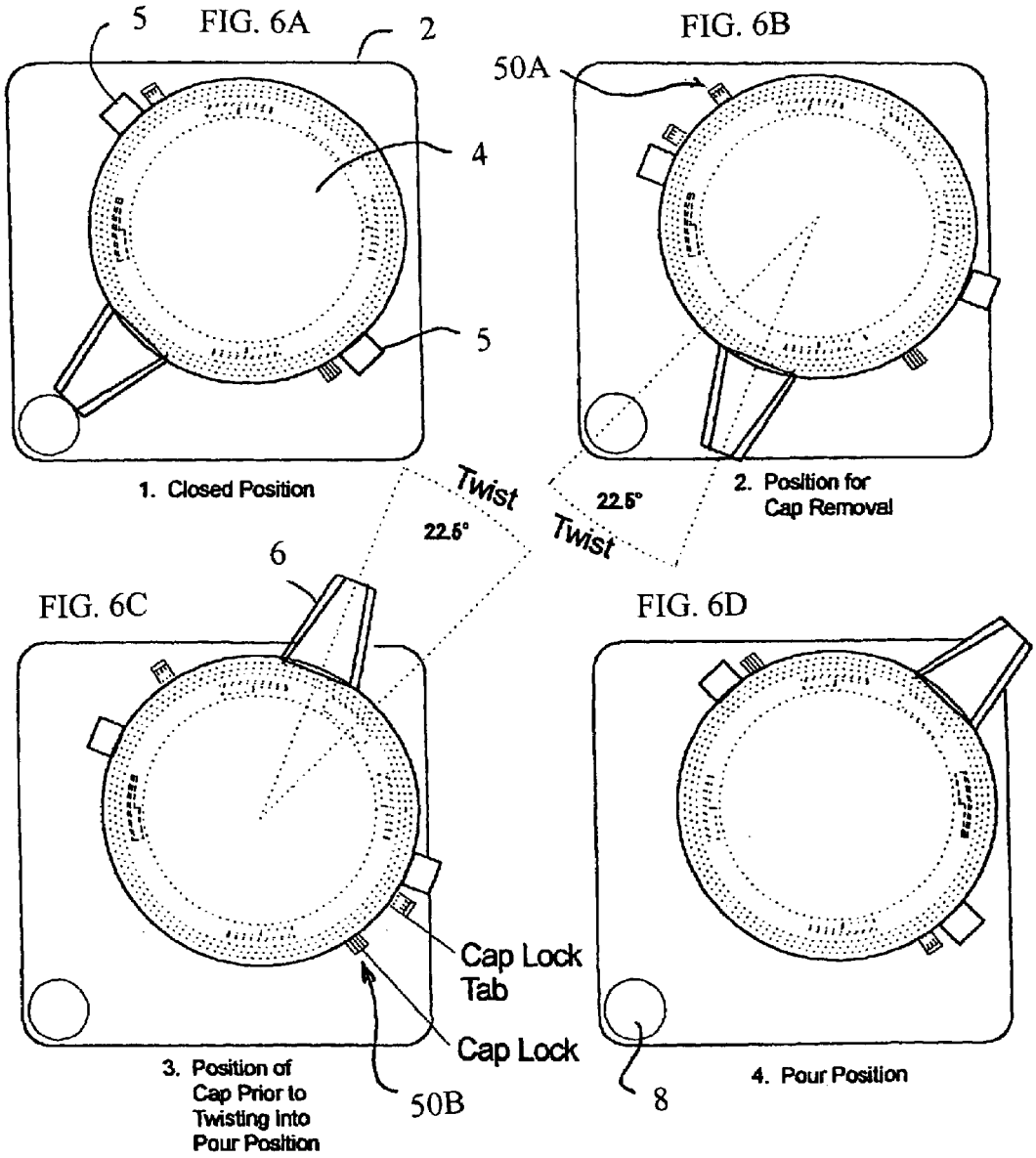
FIGS. 6A–D show various lid positions of a preferred embodiment of the present invention.

A preferred one-gallon embodiment of the present invention can be described by reference to the figures. This embodiment is an improved version of an embodiment of a paint can described in U.S. Pat. No. 5,855,304 issued to the present inventors and much of the description of this first preferred embodiment is similar to descriptions in that patent. FIG. 1 shows a prospective view of the '304 paint can. FIGS. 3A and B and 4A and B show views of Applicants' 304 patent. FIG. 2 shows a side view incorporating a new feature that is a space under the body of the can for storage of the lid (as shown at 10) when the lid is removed for painting. This embodiment is injection molded from polyethylene plastic formulated for ultraviolet protection of the contents and to provide surface to which paint to be contained will not stick. There are four parts to the can: can body 2, cap 4, pour-valve 6 and vent cap 8 as shown in FIG. 6A.

Bayonet Type Cap Seal

Figure 5:
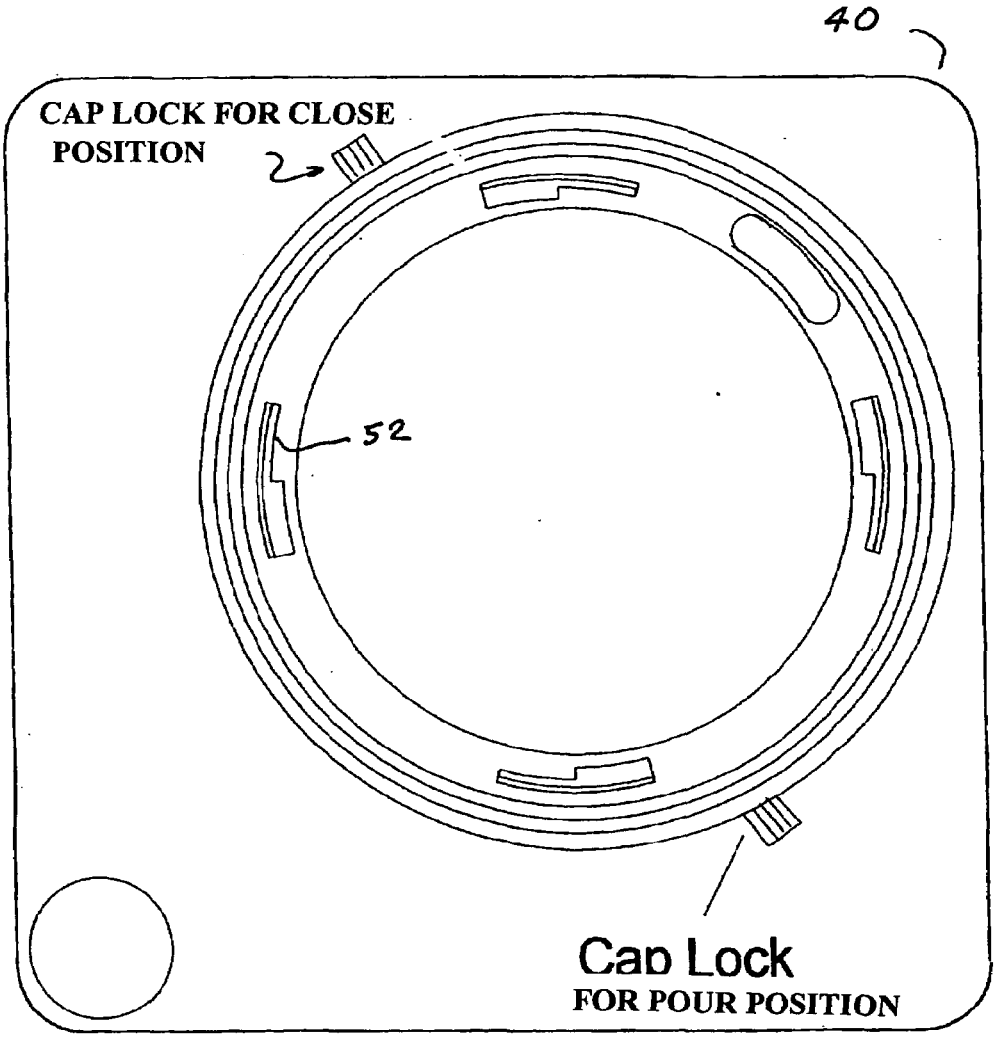
FIG. 5 shows a top view of the body of a preferred embodiment present invention.

Preferred embodiments of the present invention include, for covering the large opening in the can body, a cap with a bayonet type locking seal with releasable tab. This embodiment is shown in FIGS. 5 through 9C. FIG. 5 shows a top view of the body of a preferred embodiment present invention. The shape of the container is generally square, 7 ½ inches on each side, with rounded corners as shown at 40. The opening in the top of the container is a circle with a diameter of about 4 ½ inches. The lid 4 diameter is about 6 inches. The container is about 6 inches high. It sits on short legs as shown in FIG. 2 providing a space for storage of the lid while it is removed. The short legs also makes stacking of the cans easy.

Figures 7A, 7B, 7C, 7D:
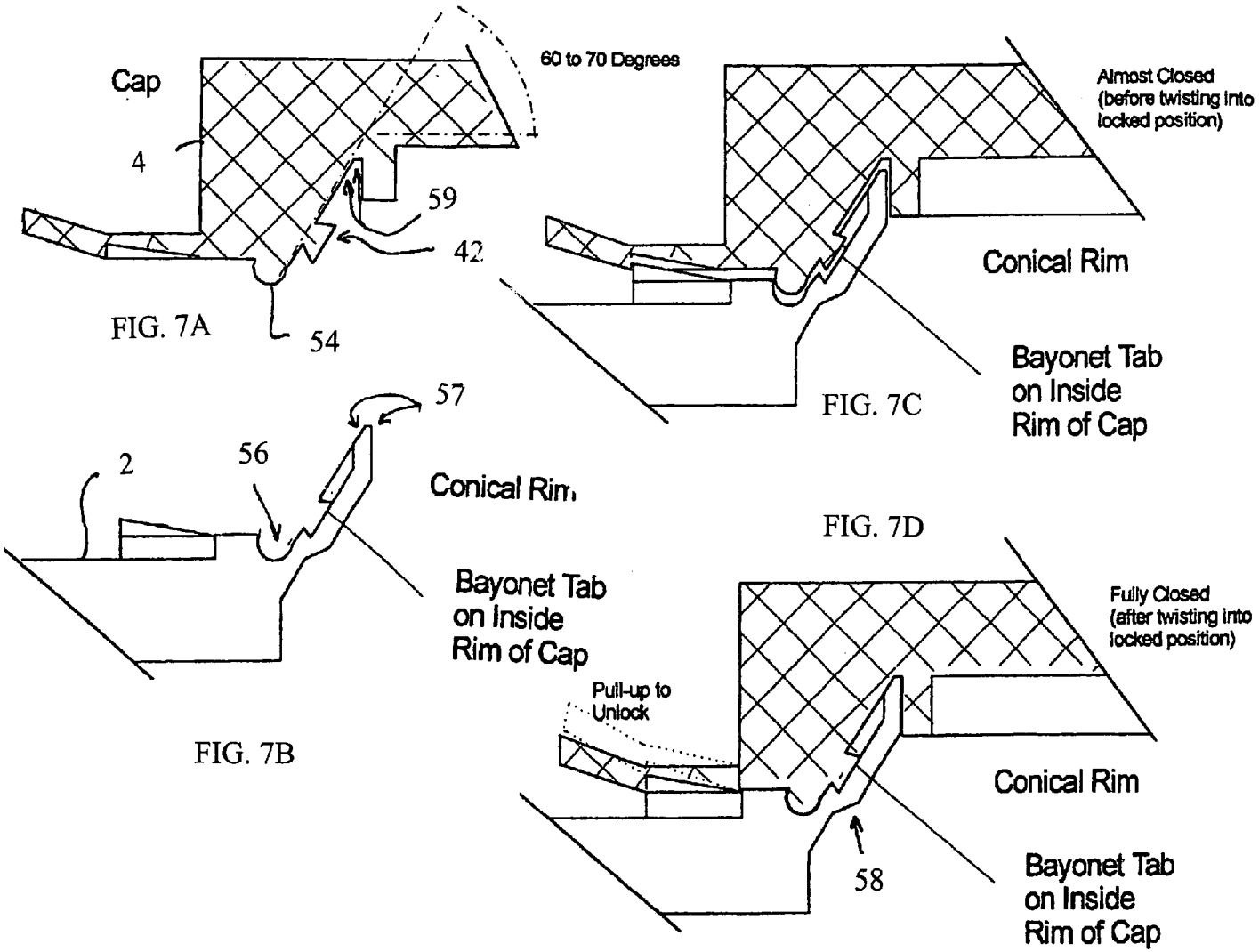
FIGS. 7A–D show how the lid functions to seal the top opening of the embodiment.

The can lid comprises four bayonet tabs 42 as shown in FIGS. 7A and 8A. To place the lid in a closed position the lid is placed in the position shown in FIG. 6B and then rotated clockwise to the position shown in FIG. 6A. The 6B position of each of the four tabs 42 is shown at 44 in FIG. 8A. The 6A close position is shown at 46 in FIG. 8A. A cap lock tab 47 is provided to lock the lid in the close position. The tab comprises three half arrowhead shaped sockets 48 which match up with three half arrowhead shaped lock elements 50A to lock the cap in the closed position. As shown at 52 in FIG. 8C. Cap lock tab 47 is flexible and is easily lifted up as shown in FIG. 7D to unlock the lid from its closed and locked position so it can be removed. A seal is provided in the closed position as shown in FIGS. 7A–D. As bayonet tab 42 slides inside bayonet tab slide pocket 52 the lid is forced in a downward direction until groove tab 54 of lid 4 seals firmly in groove 56 in container body 2 as shown at 58 in FIG. 7D. At the same time seal surfaces 57 is forced against surfaces 59 as shown in FIG. 7A to complete the sealing of the lip.

To place the lid in its pour position the lid is moved from the closed position shown in FIG. 6A to its removal position as shown in FIG. 6B and the lid is removed. It is then placed in the position shown in FIG. 6C and then rotated clockwise 22.5 degrees to the pour position as shown in FIG. 6D. Once the lid is in the pour position the lid is sealed as explained except for the pour opening. All features are the same except the cap lock for the pour position 50B is on the opposite side from cap lock 50A.

Figure 9A:
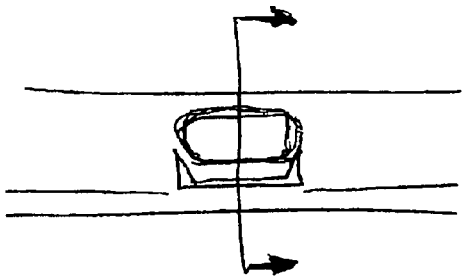
FIGS. 9A–C show the working of a swivel pour valve.
Figure 9B:
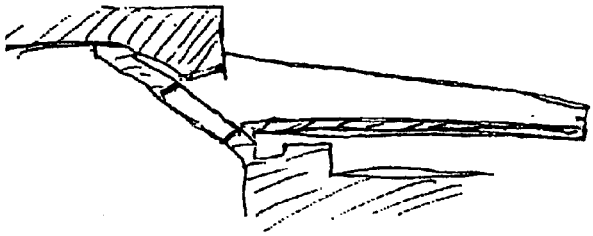
Figure 9C:
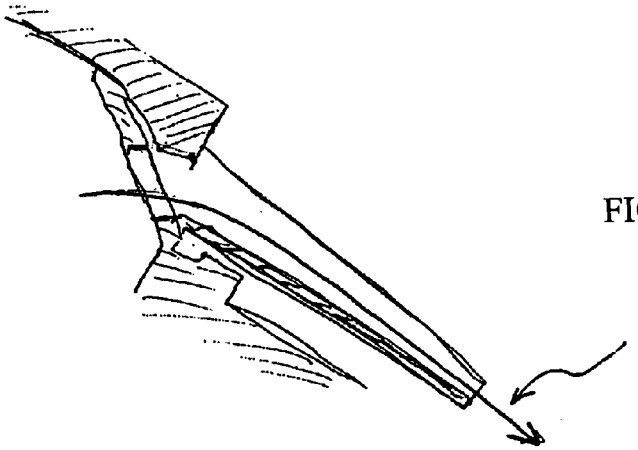

FIGS. 9A–C show the working of a swivel pour valve. FIGS. 9A and 9B show sections on the lid in the pour position and FIG. 9C shows the direction of fluid being poured out of the container at 60.

Other Features

A straight edge can be provided in main opening 16 for paintbrush wiping when brush painting directly from the can. As shown in FIG. 2, the main cap 4, when removed, can be stored in the space provided in the bottom of the can 10 to keep it from being stepped on. The can body 2 may have one or more smooth contoured vertical and/or horizontal ribs to stiffen the sides for applications that would tend to cause the sides to bulge and to permit very high stacking of the cans. This could be high temperature storage or the larger cans. The ribs should have a smooth contour and aligned to assure all the paint will flow over the ribs when paint is poured from the can. All openings can be covered with metallic foil or other stick-on seals for shipping and storage if needed depending on the contents of the can.

Main Cap

Main cap 4 is a molded cap of a material that may be different from the can, such as polypropylene. It has a 22.5-degree bayonet type tabs matching the lip 52 in the body. Various closing, opening, storing and pour positions are shown in the figures. The cap comprises two boss protrusions 5 positioned 180 degrees apart on the circumference of the cap to aid in opening the cap. The boss protrusions are also used to attach the cap to the recessed area of the can bottom for storage.

Vent Cap

Vent cap 8 is a standard threaded, or snap on cap, of a material that may be different from the material of the can body, such as polypropylene. The male threaded lip for the cap is molded as an integral part of the can body 2 as shown at 28 in FIG. 9. As with other openings in the can body this opening could also be provided with a polyethylene diaphragm or other removable seal cover to prevent leakage prior to use. Colors can be added to neutral colored paint at retail sales facilities through the vent cap.

Container Features

The special features of this embodiment of the present invention provides some very important improvements over prior art paint cans. Following are some of the advantages of this embodiment over standard available round metal or plastic paint cans: Square versus round shape permits about 20% more paint to be shipped and stored in the same volume of space. Paint can be poured from the can with no corners, edges, rims or other features obstructing the full flow and complete emptying of can. External screw thread or bayonet type access cap provides repeatable closings without fatigue and gradual loss of sealing capability or contamination of the threads or tabs with paint. A 4 ½ inch minimum opening allows a 4 inch brush and a power paint spray suction line with filter to be easily inserted into the can interior without cutting holes or breaking tabs (i.e. without damaging can). The large screw or bayonet type cap has two boss protrusions on cap edge located 180 degrees apart and over the top of the can to facilitate opening. Openings may have breakout diaphragms or stick-on metalic foil seals to prevent spills during shipping and storage prior to use and to prove lack of tampering. The screw or snap on vent cap is provided for color mixing of base color paints. After removal of cap, a paint brush straight edge wiper on the rim, slopping towards the center of the opening for paint from brush wipe to drain back into can. The raised sealing rim at the large opening allows stirring of the contents without spilling or contaminating sealing surfaces. Cap pour valve 6 allows for very controlled pouring of paint without spills or contamination and easy resealing of the opening by simply rotating the cap 180 degrees. Smooth pouring out of drip-proof spout prevents dripping of paint outside of can. Valve pour cap 6 can be turned from full open to partially open to regulate the flow out of the can. Vent cap can be loosened to break vacuum during pours. The bottom/top configuration of the can provides easy stacking regardless of orientation. The container can be reused for handling other liquids besides paint with many of the same advantages as discussed above. The size (volume) can be easily adjusted in manufacturing for any capacity of contents without changing concept and by adjusting size of openings. Use of materials, such as plastic, to construct the can results in it being chemically resistant to and not naturally affected by paints, enamels, lacquers, sealers, thinners, inks, glues, alcohols, and other conventional commercial, and industrial cleaners, solvents and solutions on which the invention would have application. To prevent chemical reaction of the liquid in the can and the can, different plastics may be chosen for different liquids. Furthermore, the plastics may be chemically treated or coated to prevent reactions or the sticking of can contents to surfaces.

Use of material, such as plastic, eliminates rusting. Material and material thickness can be easily selected to render said can sufficiently rigid to contain density of material without sagging deflections and to allow stacking equal to current containers. Plastic materials such as polyethylene or polyvinyl chloride should preferably be chemically treated to protect the contents from ultra-violet light damage and to make it impervious to oil-based solvents and molded to appropriate shapes using any of several well known plastic molding techniques such as blow molding or injection molding. Selecting specific plastics is required for each of the parts to prevent material ratcheting or galling between parts that are threaded or snapped together.

Containers for Other Liquids

Preferred embodiments of this invention is very useful for many liquids other than paint products. Its easy pour and resealing features make the present invention ideal for fruit juices and other consumable liquids including drinking water in family style sizes. In fact almost anything that needs to be poured for use could be sold in a container of the present invention. In addition, containers of the present invention may be marketed as containers to end users who would use them as a re-sealable pitcher.

Other Embodiments

Figure 12:
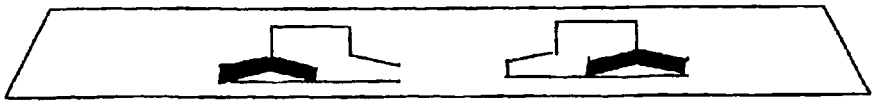

While the above description contains many specificities, the reader should not construe these as limitations on the scope of the invention, but merely as exemplifications of preferred embodiments thereof. Those skilled in the art will envision many other possible variations are within its scope. For example the lids shown can be used on many sizes other than one gallon. The shape of the bottom of the can does not have to be square. Other rectangular shapes would provide most of the advantages of the square shape. They would work very well at the sizes specified on, for example, five gallon cans. On cans substantially smaller than one gallon, such as one-quart sizes, features would be reduced. Many materials could be substituted for the plastic material specified, such as polypropylene, polyvinyl chloride, and polyethylene terephthalate. Furthermore the main cap 4, the vent cap 8, and the pour valve 6 may be made from a material different than the can body 2, to ease the ability to rotate these parts. It should be possible as shown in FIG. 12 to arrange the bayonet features of the cap and the body so that seals could be achieved in the closed and pour positions by having two sets of bayonet tabs and matching lips, one set for closing in a clockwise direction of rotation and the other set for closing in a counter-clockwise direction of rotation.

Some paint suppliers may prefer to have a knock out or screw opening in the diaphragm or the straight edge part of the main opening for color mixing rather as an alternative to adding color through the vent opening. A permanent or removable large diameter round plastic strap-type handle to assist carrying and pouring can be attached to sides of can in the slot shown on the side of the can in FIG. 11 so as to not interfere with stacking and screw cap removal. A plastic bail could be attached to a rim on the top of the can instead of the removable flat plastic strap type handle. This same attachment pocket in the side of the can for the removable handle could also be used to hold an empty can, after cleaning, on a peg-board where the can with a cut-off top would hold parts, supplies, etc. in a home-owner's workshop or sewing room. A hand-grip as shown in FIG. 11 could be molded into the body of the can.

Accordingly, the reader is requested to determine the scope of the invention by the appended claims and their legal equivalents, and not by the examples that have been given.

We claim:

1. A container for containing paint or other fluids comprising:

A) a container body comprising:

1) at least one top opening in the top having a diameter larger than 4 inches, 2) a plurality of bayonet type threads located along a circumference of said opening, and 3) a pour opening in a wall section surrounding said top opening;

B) a bayonet type pouring and closing cap covering said first circular opening and comprising:

1) a pour channel extending in a general radial direction out from said circumference; and 2) a plurality of bayonet type threads mating with said plurality of bayonet type threads in said container body so as to provide a closed seal position of said cap sealing said top opening and a pour position sealing said top opening except for said pour channel;

wherein said bayonet type pouring and closing cap provides at least four cap positions: a close position, two remove-replace cap position and a pour position; said close position being achieved by placing said cap in one of said two remove-replace cap position and rotating the cap in a first rotation direction to said close position and said pour position being achieved by placing said cap in another of said two remove-replace cap positions and rotating said cap in the said first rotation direction to said pour position.

2. The container in claim 1 wherein:

1) a portion of said sides of said can body extend beyond the bottom of said can body defining an extended bottom edge providing a space for storing of said cap when the cap is removed from said circular opening and 2) said can body further comprises a top stacking stub, wherein said ears and said stub being positioned to provide a three-point frame work matched to said bottom edge to facilitate stacking of said plurality of cans.

3. The container as in claim 1 and further comprising a locking mechanism for locking said cap in said close position an a release mechanism for releasing said locking mechanism.

4. The container as in claim 1 and further comprising a locking mechanism for locking said cap in said pour position an a release mechanism for releasing said locking mechanism.

5. The container as in claim 3 wherein said locking mechanism comprises at least one lock element shaped like half an arrowhead and at least one matching half-arrowhead shaped socket with the lock element on one of the body and the cap and the socket on the other of the body and the cap.

6. The container as in claim 4 wherein said locking mechanism comprises at least one lock element shaped like half an arrowhead and at least one matching half-arrowhead shaped socket with the lock element on one of the body and the cap and the socket on the other of the body and the cap.

7. The container as in claim 1 and further comprising a vent mean for relieving any vacuum in the can created by pouring.

8. The container as in claim 7 wherein the vent means is located in said cap.

9. The container as in claim 7 wherein the vent means is located in said body.

10. The container as in claim 1 and further comprising a wiping means in said main opening for wiping excessive paint from paint brushes.

11. The container as in claim 1 wherein said container is comprised of plastic.

12. The container as in claim 1 wherein said plastic is polyethylene.

13. The container as in claim 1 and further comprising removable diaphragms covering said first circular opening and said valve opening.

14. The container as in claim 1 wherein said container comprises a rectangular or square bottom.

15. A container for containing paint or other fluids comprising:

A) a container body comprising:

4) at least one top opening in the top having a diameter larger than 4 inches, 5) a plurality of bayonet type threads located along a circumference of said opening, and 6) a pour opening in a wall section surrounding said top opening;

B) a bayonet type pouring and closing cap covering said first circular opening and comprising:

3) a pour channel extending in a general radial direction out from said circumference; and 4) a plurality of bayonet type threads mating with said plurality of bayonet type threads in said container body so as to provide a closed seal position of said cap sealing said top opening and a pour position sealing said top opening except for said pour channel;

wherein said bayonet type pouring and closing cap provides at least four cap positions: a close position, two remove-replace cap position and a pour position; said close position being achieved by placing said cap in one of said two remove-replace cap position and rotating the cap in a first rotation direction to said close position and said pour position being achieved by placing said cap in another of said two remove-replace cap positions and rotating said cap in a second rotation direction opposite said first rotation direction to said pour position.

* * * * *